United States Patent [19]

Paquet

[11] 4,353,173

[45] Oct. 12, 1982

[54] INSOLES FOR SKATE BOOTS

[75] Inventor: Benoit Paquet, St. Jean, Canada

[73] Assignee: Canada Cycle and Motor Company Limited, Weston, Canada

[21] Appl. No.: 44,276

[22] Filed: May 31, 1979

[30] Foreign Application Priority Data

Aug. 8, 1979 [CA] Canada ..... 327199

[51] Int. Cl.[3] ..... A43B 13/38; A43B 5/16; A43C 13/14

[52] U.S. Cl. ..... 36/44; 36/77 R; 36/83; 36/115

[58] Field of Search ..... 36/44, 43, 115, 77 R, 36/83; 128/595

[56] References Cited

U.S. PATENT DOCUMENTS

| | | | |
|---|---|---|---|
| 424,195 | 3/1890 | Haag | 36/44 UX |
| 621,238 | 3/1899 | Forbush | 36/44 |
| 955,104 | 4/1910 | Rollins | 36/43 X |
| 1,986,580 | 1/1935 | Johnson | 36/115 X |
| 2,740,209 | 4/1956 | Shultz | 36/77 R |

FOREIGN PATENT DOCUMENTS

| | | | |
|---|---|---|---|
| 569571 | 8/1958 | Belgium | 128/595 |
| 783319 | 4/1968 | Canada | 36/77 R |
| 1046760 | 1/1979 | Canada | 36/115 |
| 2395719 | 1/1979 | France | 36/44 |
| 2001844 | 2/1979 | United Kingdom | 36/44 |

*Primary Examiner*—James Kee Chi

*Attorney, Agent, or Firm*—Rogers, Bereskin & Parr

[57] ABSTRACT

A laminated insole for a skate boot is disclosed. The insole includes a base layer moulded in a relatively rigid plastic material and an inner layer of a relatively resilient material laminated to the base layer. The base layer has a raised central portion in its outer surface which provides a strengthening spine for the insole and which is surrounded by a relatively flat peripheral surface portion onto which the margin of a lasted upper can be secured in constructing a boot. The raised central portion has a thickness corresponding generally to the thickness of the margin of the upper so that the bottom surface of the upper/insole combination is generally flat.

6 Claims, 9 Drawing Figures

INSOLES FOR SKATE BOOTS

This invention relates generally to skate boots; that is, boots of the kind to which ice or roller skates can be fitted. In particular, the invention is concerned with insoles used in the construction of such boots.

In an ice skate boot, for example, the insole forms a structural part of the boot to which the upper of the boot is attached. The upper is initially open at its lower end and the bottom margin of the upper is folded inwardly over the insole and secured thereto during construction of the boot. A relatively rigid outsole is attached below the insole and the skate itself is secured to the boot by rivets passing through the outsole and insole.

Boots of this kind are relatively expensive, primarily because numerous manufacturing steps are involved in preparing the insoles and incorporating them into the boot structure. Also, conventional insoles are made from relatively high quality leather stock, which is expensive. The insoles are individually die cut from the leather stock on a beam press machine. They must then be levelled to uniform thickness using a splitting machine, which removes excess leather from the surface of the insole. Next, each insole is skived to remove material from the bottom surface of the insole in the foot arch support area. The shaped insole is then shaped by cramping in a press to follow the contour of the bottom of a last on which the boot is to be built.

Following these preparatory operations, the insole is temporarily tacked to the last and a rotary cutting machine is used to remove any excess material from the edge of the insole so that a level edge is produced to improve shoe lasting contour and fit. A prepared boot upper is then fitted around the last and its bottom margin is folded over around the insole and secured thereto by tacking and using a suitable cement. Next, a tempered steel shank shaped to conform with the contour of the bottom of the last is glued to the insole for strengthening purposes. A cork filler made up of ground cork mixed with glue is then applied to the insole to fill in the space between the shank and the inwardly turned edges of the upper and is pressed into place to form a generally flat surface, to which the outsole is finally cemented.

It will be appreciated that these operations are relatively highly labour intensive and time consuming, which factors are reflected in the cost of the finished boot.

An object of the present invention is to provide an improved insole which makes for simplified boot manufacture compared with the prior art. A boot structure incorporating such insoles is also provided.

According to one aspect of the invention there is provided an insole of laminated construction including a base layer moulded in relatively rigid plastic material and having a profile corresponding generally to the shape of a human foot and of a size appropriate to the required boot size. The base layer has an inner surface smoothly contoured to generally follow the contours of the sole of a wearer's foot, and an outer layer having a raised central portion which extends longitudinally of said outer surface and provides a strengthening spine for the insole. The raised central portion has a profile which follows the profile of the base layer and defines a relatively flat peripheral surface portion around said central portion onto which the margin of a lasted upper can be secured in constructing a boot, the raised central portion having a thickness corresponding generally to the thickness of said margin. The insole also has an inner layer of a relatively resilient material secured to and covering the inner surface of the base layer so as to provide a bearing surface for a wearer's foot.

According to another aspect of the invention there is provided a skate boot which includes an upper defining a space for receiving a wearer's foot, an insole disposed inside the upper, and a relatively rigid outsole disposed externally of and secured to the upper and insole and defining an undersurface of the boot for attachment of a skate. The insole includes a base layer moulded in a relatively rigid plastic material and having a profile corresponding generally to the shape of a human foot and of a size appropriate to the required boot size. The base layer has an inner surface smoothly contoured to generally follow the contours of the sole of a wearer's foot, and an outer surface having a raised central portion which extends longitudinally of said surface and provides a strengthening spine for the insole. The raised central portion has a profile which follows the profile of the base layer and defines a relatively flat peripheral surface portion around said central portion onto which an outer margin of said upper is secured, said raised central portion having a thickness corresponding generally to the thickness of said margin. The insole also has an inner layer of relatively resilient material secured to and covering the inner surface of the base layer so as to provide a bearing surface for a wearer's foot.

In order that the invention may be more clearly understood, reference will now be made to the accompanying drawings which illustrate a preferred embodiment of the invention by way of example, and in which.

Figure 4:
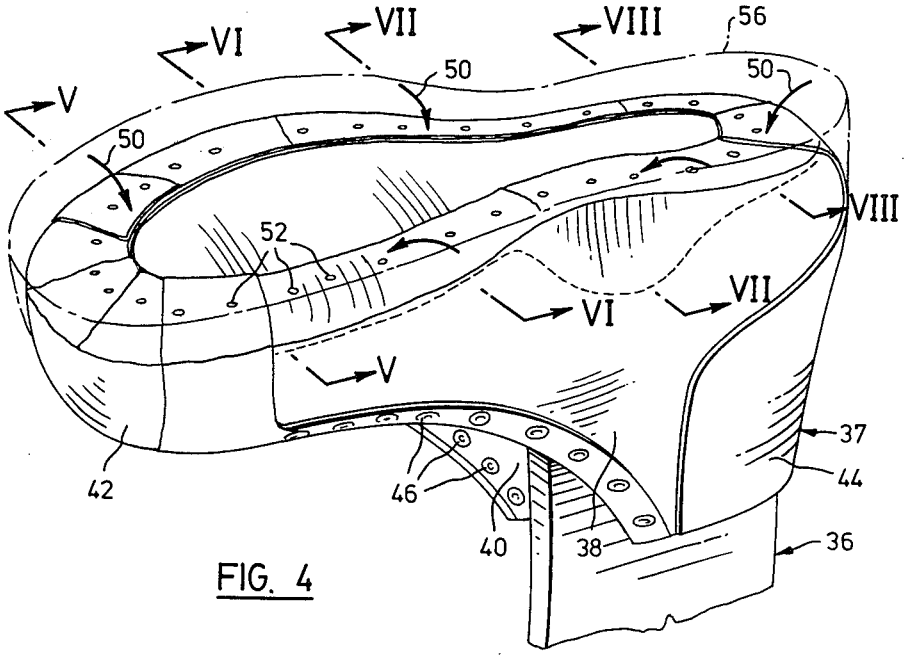
Figure 7:
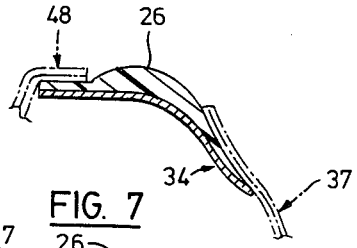
Figure 8:
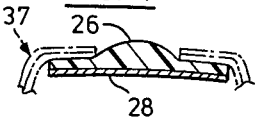
Figure 9:
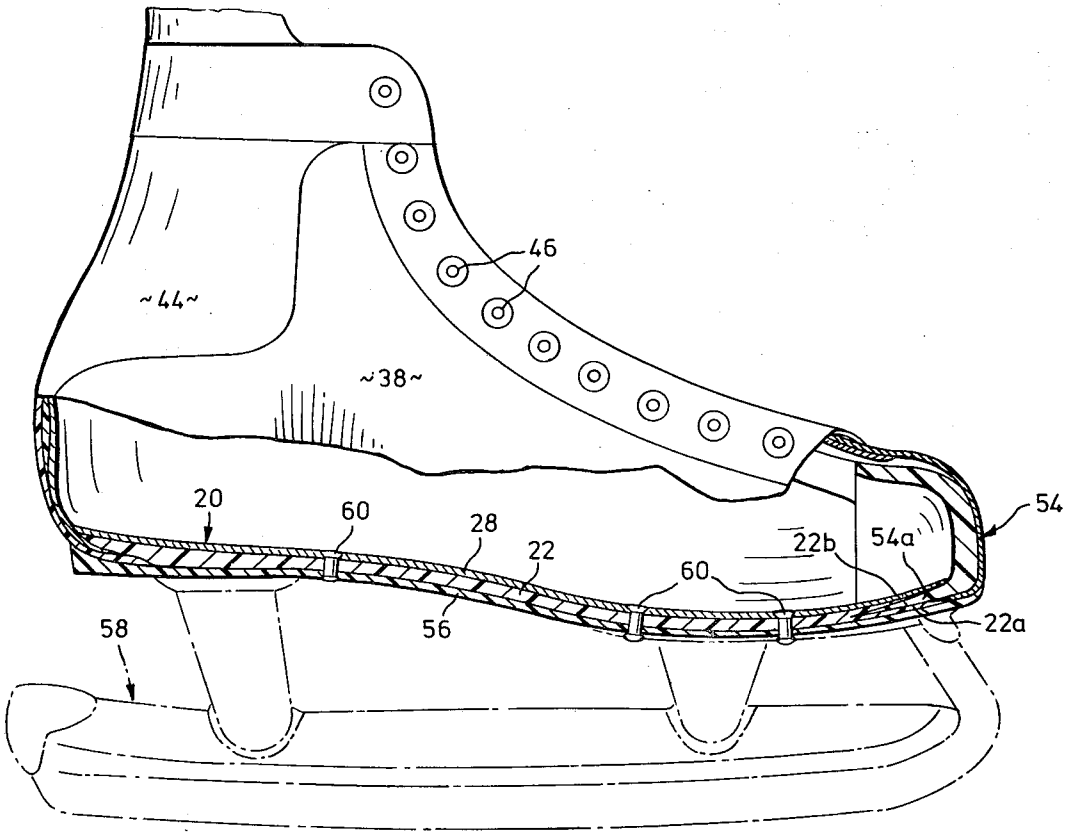

FIGS. 5 to 8 inclusive are cross-sectional views taken respectively on lines V—V, VI—VI, VII—VII and VIII—VIII of FIG. 4; and, FIG. 9 is a side view, partly in section, of the assembled boot showing, in ghost outline, an ice skate attached to the boot.

Figure 1:
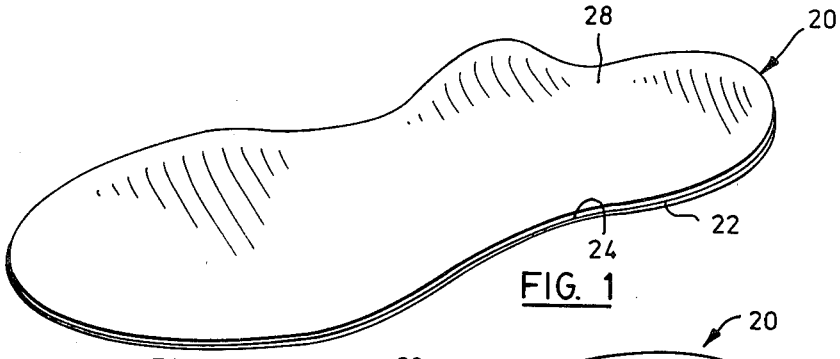
FIG. 1 is a perspective view from above of an insole for an ice skate boot according to the invention.
Figure 2:
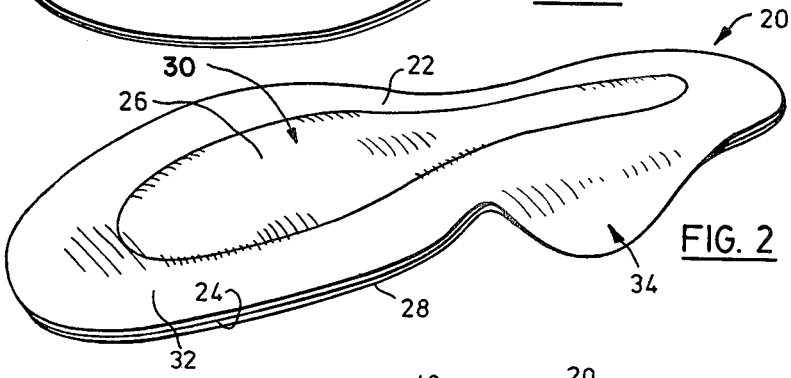
FIG. 2 is a perspective view of the insole shown in an inverted position compared with FIG. 1.

Referring first to FIG. 1, an ice skate boot insole is generally indicated at 20 and is shown in the position it will occupy in an assembled boot in wear; in FIG. 2 the insole appearas in an inverted position with its lower (tread) surface uppermost. The insole is of laminated construction and includes a base layer 22 (FIG. 2) which is moulded in a relatively rigid plastic material, and which has a profile corresponding generally to the shape of a human foot and of a size appropriate to the required size of boot into which the insole is to be incorporated. The base layer has an inner surface 24, and an outer surface 26, (which appears uppermost in FIG. 2). An inner layer 28 of a relatively resilient material is secured to base layer 22 and covers its inner surface 24 so as to provide a bearing surface for a wearer's foot in use.

In this particular embodiment, the inner layer 28 is made of leather and is formed by a leather blank of approximately 1/16" thickness made by die cutting from leather stock. The base layer is made of the plastic material sold under the trade mark SURLYN. The leather blank is placed in the cavity of a suitable mould in an injection moulding machine, and the plastic material is injected into the cavity above the blank and bonds with the blank to form the laminated insole structure described. No special shaping or other processing of the leather blank is required. The shape of the insole is determined by the shape of the mould cavity and provides the required contours on the insole as described and illustrated herein.

The inner surface 24 of base layer 22 is smoothly contoured to generally follow the contours of the sole of a wearer's foot and the leather blank which forms inner layer 28 is forced to follow this contour by the pressures exerted thereon during the injection moulding operation. Thus, the contour of the inner surface of base layer 22 will be generally the same as the contour of the inner layer 28 as seen in FIG. 1. The outer surface 26 of the base layer has a raised central portion 30 which extends longitudinally of said surface and provides a strengthening spine for the insole. Portion 30 has a profile which follows the profile of the base layer and defines a relatively flat peripheral surface portion 32 around said central portion onto which the margin of the lasted upper can be secured in constructing a boot, as will be more specifically described later. The raised central portion 30 has a thickness corresponding generally to the thickness of said boot margin as can best be seen in FIGS. 5 to 8 (to be described).

The insole shown in FIGS. 1 and 2 is shaped for a left boot and includes, in the instep area of the insole, a portion 34 which protrudes laterally from the insole and is curved upwardly to overlie the instep area of the foot of a wearer. This portion of the insole is known as the "cookie" in a conventional insole. However, in this case, the cookie is of laminated construction and is formed by integral portions of the base layer and inner layer of the insole. The mould in which the insole is formed is shaped so that the base layer tapers towards the outer edge of the cookie so that the cookie, at least towards its outer edge, tends to be somewhat more flexible than the remainder of the insole.

Figure 3:
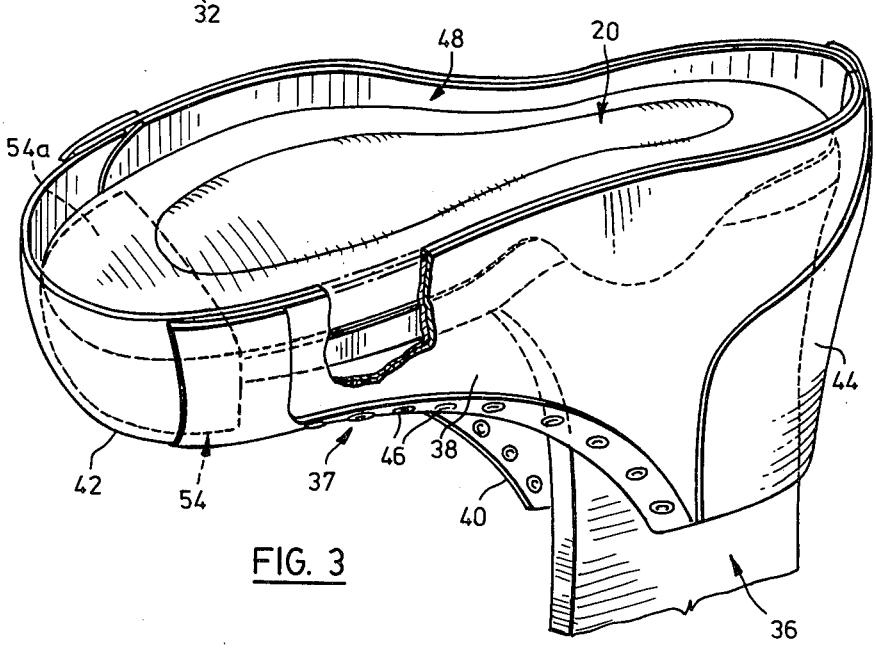
FIGS. 3 and 4 are perspective views of a boot upper mounted on a last to which the insole of FIGS. 1 and 2 has been secured, and illustrate sequential steps in the construction of a boot using the insole.

FIGS. 3 to 8 illustrate how the insole 20 is incorporated in a boot during its construction. In FIGS. 3 and 4, a conventional last is indicated somewhat diagrammatically by reference numeral 36. The last is shaped to resemble the shape of a human foot of the size the boot is to fit and has a bottom (sole) surface to which the insole 20 is temporarily attached by tacks (not shown) as in the case of a conventional insole. A prepared upper 37 is shown fitted to the last and surrounding insole 20. The upper is manufactured separately by known techniques and is essentially of conventional construction; accordingly, the upper will not be described in detail. For present purposes, it is sufficient to note that the upper is designed to receive and support a wearer's foot and includes suitable side pieces 38, 40, a toe piece 42 and a heel or tendon piece 44. The side pieces are provided with lacing openings generally indicated at 46. Some or all of the components of the boot may be made of plastic or other synthetic materials as is conventional in the art. In any event, the upper defines a bottom margin generally denoted 48, which projects upwardly from the last and extends around the insole when the upper is mounted in its inverted position on the last as shown in FIGS. 3 and 4.

The upper margin 48 is relatively flexible so that it can be folded inwardly down onto the flat peripheral surface portion 32 of insole 20 generally as indicated by the arrows 50 in FIG. 4. Before the margin is folded down, a suitable hot melt adhesive is applied to the peripheral surface portion 32 of the insole on the last. A tacking machine is used to apply tacks such as those indicated at 52 to temporarily hold down the folded margin while the adhesive sets.

The height of the margin 48 and the width of the peripheral surface portion 32 of the insole are chosen so that the margin, when folded down, occupies substantially the whole of said peripheral surface portion but does not overlie the raised central portion 30 of the insole. As discussed previously, the raised central portion is of a thickness corresponding approximately to the thickness of the margin so that, when the boot is at the stage in its manufacture shown in FIG. 4, the inwardly folded margin and insole together define a generally flat surface at the bottom of the upper. In other words, the raised central portion of the insole essentially "fills in" the space which would otherwise exist in the central area of the insole after the upper margin had been folded in. At the same time, the raised central portion of the insole provides a strengthening spine which resists transverse bending of the insole and imparts the required strength thereto.

A toe protector or "box" is incorporated in the boot and is denoted by reference numeral 54 is FIG. 3. A similar component is provided in conventional boots. Box 54 is a plastic moulding and includes a generally flat base portion **54*a* which is received in a slit in the toe portion of the base layer 22 of insole 20. Layer 22 is slit from the toe end of the insole back towards the heel end to an extent just sufficient to accommodate base portion 54*a***. The slitting operation is performed manually after the insole has been manufactured. The box is then inserted into the slit and cemented in place using a suitable adhesive.

Figure 5:
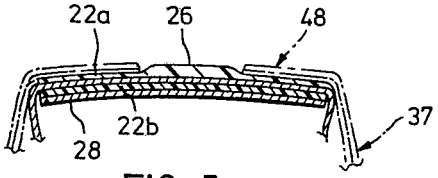

FIGS. 5 to 8 are transverse sectional views taken at four positions spaced along the upper/insole combination of FIG. 4. In FIG. 5, the base portion **54*a* of box 54 can be seen incorporated between two portions 22*a* and 22*b* of the base layer 22 of the insole. The inner layer 28 is visible at the inner side of portion 22*b***.

Figure 6:
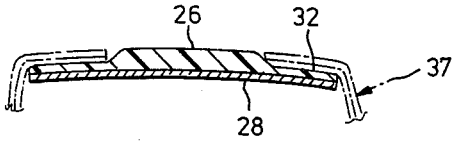

FIGS. 5 and 6 clearly illustrate how the raised central portion 30 of insole 20 co-operates with the inwardly folded margin 48 of the boot upper to define a generally flat surface to which an outsole can be attached.

The view represented by FIG. 7 is taken at the position of the cookie 34 of the insole and shows how the raised central portion 30 merges into the adjacent part of the flat peripheral surface portion 32 of the insole and then tapers off towards the outer edge of the cookie. Finally, FIG. 8 shows the cross-sectional shape of the insole adjacent its heel portion.

The final step in constructing a boot is to attach an outsole to the upper/insole combination in the form in which it is shown in FIG. 4. Typically, the outsole will be a plastic moulding and will be secured in place using a suitable adhesive. FIG. 9 shows an assembled boot complete with an outsole, denoted 56. The outsole is cemented directly to the outer surface of the inwardly folded margin 48 of the upper and to the raised central portion 30 of the insole. An ice skate such as that indicated in ghost outline 58 is then attached to the boot by rivets, typical ones of which are indicated at 60. The rivets pass through the outsole and the insole. The relatively resilient nature of the inner layer 28 of the insole allows the rivets to be set in positions in which they are depressed into the inner layer 28 to a substantial extent so as to avoid causing discomfort to a wearer. The resilient nature of layer 28 also enhances wearer comfort by providing a degree of cushioning for the foot. Additional cushioning can be provided by a separate sock (not shown) inserted into the boot.

It will be appreciated from the preceding description that the form of insole shown in the drawings greatly simplifies construction of the boot while providing strength and comfort in wear which is at least equivalent to that achieved with a conventional insole. It will also be appreciated that the preceding description relates to a specific embodiment of the invention and that many modifications are possible. For example, although the inner layer 28 of the insole has been described as being made of leather, other relatively resilient materials may be used as alternatives. The material chosen should preferably allow for rivets used to hold an ice skate to the boot, to become depressed below the surface of the insole when set and should provide for some cushioning of the wearer's foot. Resilient plastic or foam rubber materials may be suitable for this purpose. At the same time, the base layer need not be made of SURLYN plastic material; other relatively rigid plastic materials may be used.

In another embodiment of the invention, the "cookie" provided at the instep area of the insole could be formed by a separate component attached to the main portion of the insole. Conversely, where a top protector (box) is required, it could be moulded integrally with the plastic portion of the insole rather than being separate as described.

Finally, it should be noted that the insole provided by the invention may be manufactured other than by the techniques specifically disclosed herein. In another embodiment, the base layer of the insole could be moulded as a separate unit and the inner layer subsequently attached to the base layer by adhesive.

I claim:

1. An insole for a skate boot, the insole being of laminated construction and comprising: a base layer moulded in a relatively rigid plastic material and having a profile corresponding generally to the shape of a human foot and of a size appropriate to the required boot size, the base layer having an inner surface smoothly contoured to generally follow the contours of the sole of a wearer's foot, and an outer surface having a raised central portion which extends longitudinally of said surface and provides a strengthening spine for the insole, said raised central portion having a profile which follows the profile of said base layer and defines a relatively flat peripheral surface portion around said central portion which is of substantially uniform width throughout its extent and onto which the margin of a lasted upper can be secured in constructing a boot, said raised central portion having a thickness corresponding generally to the thickness of said margin and extending over substantially the entire length of the insole except for said margin; and an inner layer of a relatively resilient material secured to and covering the inner surface of said base layer so as to provide a bearing surface for a wearer's foot; the insole further including, in the instep region of the insole, an integral arch support portion which curves laterally from the remainder of the insole in said region and upwardly in a direction away from said outer surface of the base layer, so as to overlie the instep area of the foot of a wearer in use, said arch support portion being formed by parts of said inner layer and base layer and said base layer tapering towards an outer edge of said arch support portion.

2. An insole as claimed in claim 1, wherein said inner layer is formed by a relatively thin blank made of leather.

3. An insole as claimed in claim 1 or 2, wherein said plastic material is of the type sold under the trade mark SURLYN.

4. An insole as claimed in claim 2 manufactured by injection moulding said plastic material onto said blank in a mould so that said plastic material is bonded to the blank and causes the blank to adopt the configuration of the mould.

5. A skate boot including an upper defining a space for receiving a wearer's foot, an insole disposed inside the upper, and a relatively rigid outsole disposed externally of and secured to the upper insole and defining an undersurface of the boot for attachment of a skate, wherein the insole includes a base layer moulded in a relatively rigid plastic material and having a profile corresponding generally to the shape of a human foot and of a size appropriate to the required boot size, the base layer having an inner surface smoothly contoured to generally the contours of the sole of a wearer's foot and an outer surface having a raised central portion which extends longitudinally of said surface and provides a strengthening spine for the insole, the raised central portion having a profile which follows the profile of the base layer and defines a relatively flat peripheral surface portion around said central portion which is of substantially uniform width throughout its extent and onto which an outer margin of said upper is secured, said raised central portion having a thickness corresponding generally to the thickness of said margin and extending over substantially the entire length of the insole except for said margin; and an inner layer of a relatively resilient material secured to and covering the inner surface of the base layer so as to provide a bearing surface for a wearer's foot; the insole further including, in the instep region of the insole, an integral arch support portion which curves laterally from the remainder of the insole in said region and upwardly in a direction away from said outer surface of the base layer, so as to overlie the instep area of the foot of a wearer in use, said arch support portion being formed by parts of said inner layer and base layer and said base layer tapering towards an outer edge of said arch support portion.

6. A skate boot as claimed in claim 5, further comprising a toe protector which includes a base portion and wherein said base layer of the insole is formed with a slit receiving said base portion of the toe protector, said base portion being secured to said base layer of the insole by cement.

* * * * *